US009405261B2

(12) United States Patent
Jung et al.

(10) Patent No.: US 9,405,261 B2
(45) Date of Patent: Aug. 2, 2016

(54) METHOD AND APPARATUS FOR DETECTING PHASE OF INPUT POWER

(71) Applicant: SAMSUNG ELECTRONICS CO., LTD., Suwon-si, Gyeonggi-do (KR)

(72) Inventors: Hong-ki Jung, Suwon-si (KR); Jae-wan Kim, Busan (KR); Kyung-hwan So, Namwon-si (KR); Young-jun Song, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/605,074

(22) Filed: Jan. 26, 2015

(65) Prior Publication Data

US 2016/0062301 A1 Mar. 3, 2016

(30) Foreign Application Priority Data

Aug. 26, 2014 (KR) ..... 10-2014-0111625

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01)

(58) Field of Classification Search
CPC ..... G03G 15/2039; G03G 15/80
See application file for complete search history.

(56) References Cited

U.S. PATENT DOCUMENTS

2008/0069584 A1* 3/2008 Sanada ..... G03G 15/5004 399/88

FOREIGN PATENT DOCUMENTS

| | | |
|---|---|---|
| JP | 2004-328869 | 11/2004 |
| JP | 2005-286707 | 10/2005 |
| JP | 2006-042541 | 2/2006 |

* cited by examiner

*Primary Examiner* — Erika J Villaluna
(74) *Attorney, Agent, or Firm* — Staas & Halsey LLP

(57) ABSTRACT

A phase detector includes an alternating current input unit to which input power is applied; a zero cross generator that outputs a zero cross signal at a zero cross point of the input power by using a photo coupler; and a zero cross detector that converts the zero cross signal to a pulse signal and detects the phase of the input power based on the pulse signal. A compensation capacitor is connected in parallel at a first side of the photo coupler.

16 Claims, 8 Drawing Sheets

METHOD AND APPARATUS FOR DETECTING PHASE OF INPUT POWER

CROSS-REFERENCE TO RELATED APPLICATIONS

This application claims the priority benefit of Korean Patent Application No. 10-2014-0111625, filed on Aug. 26, 2014, in the Korean Intellectual Property Office, the disclosure of which is incorporated herein in its entirety by reference.

BACKGROUND

1. Field

One or more exemplary embodiments relate to a method and apparatus for detecting a phase of input power.

2. Description of the Related Art

An image forming apparatus includes a fuser that fuses image onto printing paper by applying heat. Since a temperature of the fuser may affect printing quality, it is necessary to accurately adjust the temperature of the fuser.

In order to control the temperature of the fuser, the image forming apparatus may use a phase control method by detecting a phase of input power. In other words, the image forming apparatus may adjust electric power supplied to heat the fuser by using the phase control method.

SUMMARY

One or more exemplary embodiments include a method and apparatus for detecting a phase of input power for driving a fuser.

Also, one or more exemplary embodiments include a non-transitory computer-readable recording medium having recorded thereon a program, which, when executed by a computer, performs the method above. The technical goals are not limited thereto, and other technical goals may be derived from exemplary embodiments below.

According to one or more exemplary embodiments, a phase detector for detecting a phase of input power for driving a fuser of an image forming apparatus includes an alternating current (AC) input unit to which the input power is applied; a zero cross generator that outputs a zero cross signal at a zero cross point of the input power by using a photo coupler; and a zero cross detector that converts the zero cross signal to a pulse signal and detects the phase of the input power based on the pulse signal. A compensation capacitor is connected in parallel at a first side of the photo coupler.

According to one or more exemplary embodiments, an image forming apparatus for driving a fuser by controlling a phase includes a fuser driver board that outputs a zero cross signal at a zero cross point of input power by using a photo coupler; and a main board that converts the zero cross signal to a pulse signal and detects a phase of the input power based on the pulse signal. A compensation capacitor is connected in parallel at a first side of the photo coupler.

According to one or more exemplary embodiments, a phase detecting method of detecting a phase of input power for driving a fuser of an image forming apparatus includes outputting a zero cross signal at a zero cross point of the input power by using a photo coupler; converting the zero cross signal to a pulse signal; detecting the phase of the input power based on the pulse signal; and adjusting a magnitude of a capacitance of a compensation capacitor at a first side of the photo coupler according to a shape of the pulse signal.

According to one or more exemplary embodiments, an apparatus controlling a temperature of a fuser via a fuser heater in an image forming apparatus includes a zero cross generator to generate a zero cross signal at a zero cross point of power input to the image forming apparatus and a zero cross detector to convert the generated zero cross signal to a pulse signal, to detect a phase of the input power based on the converted pulse signal, and to control an electric power supplied to the fuser heater based on the detected phase of the power input.

The zero cross generator includes a compensation capacitor connected in parallel to a photo coupler.

In the zero cross generator, a magnitude of a capacitance of the compensation capacitor of the photo coupler is adjusted according to a shape of the converted pulse signal.

According to one or more exemplary embodiments, an apparatus for controlling a temperature of a fuser via a fuser heater in an image forming apparatus includes a zero cross generator to generate a zero cross signal at a zero cross point of power input to the image forming apparatus and a zero cross detector to convert the generated zero cross signal to a pulse signal, to detect a phase of the input power based on the converted pulse signal, and to control an electric power supplied to the fuser heater based on the detected phase of the power input.

The zero cross generator may include a compensation capacitor connected in parallel to a photo coupler.

A magnitude of a capacitance of the compensation capacitor of the photo coupler is adjusted according to a shape of the converted pulse signal.

According to one or more exemplary embodiments, a method of controlling a temperature of a fuser via a fuser heater in an image forming apparatus includes detecting a phase of AC power input to the image forming apparatus and controlling an electric power supplied to the fuser heater by adjusting a compensation capacitor in a photo coupler according to the detected phase of the AC power input to the image forming apparatus.

Additional aspects and/or advantages will be set forth in part in the description which follows and, in part, will be apparent from the description, or may be learned by practice of the exemplary embodiments.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
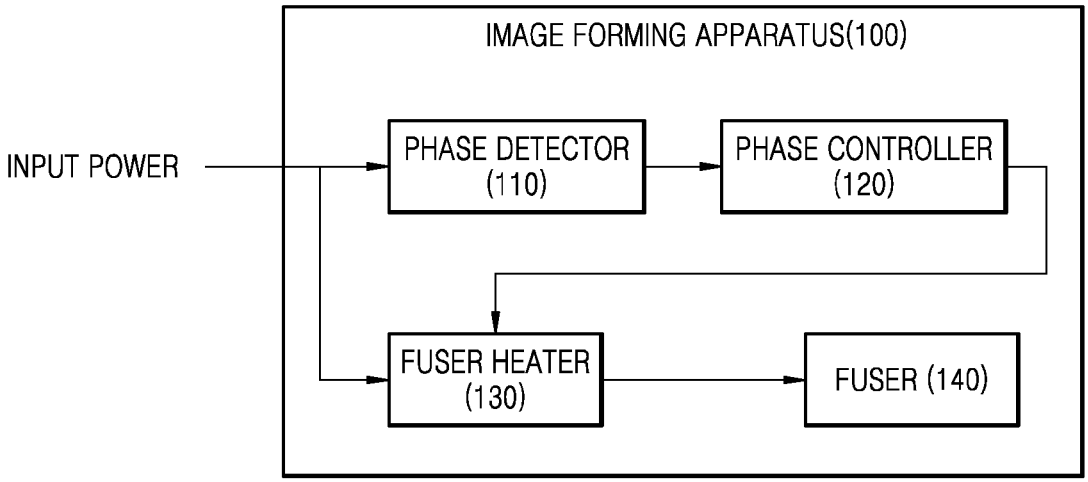
FIG. 1 is a block diagram of an image forming apparatus according to an exemplary embodiment.

As the inventive concept allows for various changes and numerous exemplary embodiments, particular exemplary embodiments will be illustrated in the drawings and described in detail in the written description. However, this is not intended to limit the inventive concept to particular modes of practice, and it is to be appreciated that all changes, equivalents, and substitutes that do not depart from the spirit and technical scope are encompassed in the inventive concept. In the description, certain detailed explanations of the related art are omitted when it is deemed that they may unnecessarily obscure the essence of the inventive concept.

While such terms as "first," "second," etc., may be used to describe various components, such components must not be limited to the above terms. The above terms are used only to distinguish one component from another.

The terms used in the present specification are merely used to describe particular embodiments, and are not intended to limit the inventive concept. An expression used in the singular encompasses the expression of the plural, unless it has a clearly different meaning in the context. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Reference will now be made in detail to exemplary embodiments, examples of which are illustrated in the accompanying drawings. Like reference numerals in the drawings denote like elements, and thus their description will be omitted. As used herein, the term "and/or" includes any and all combinations of one or more of the associated listed items. Expressions such as "at least one of," when preceding a list of elements, modify the entire list of elements and do not modify the individual elements of the list.

FIG. 1 is a block diagram of an image forming apparatus 100 according to an exemplary embodiment. Referring to FIG. 1, the image forming apparatus 100 may include, for example, a phase detector 110, a phase controller 120, a fuser heater 130, and a fuser 140.

The image forming apparatus 100 may detect a phase of input power and thereby control a temperature of the fuser 140. In other words, the image forming apparatus 100 may adjust electric power supplied to heat the fuser by using a phase control method.

The image forming apparatus 100 may be an apparatus such as a printer, a fax machine, or a combination of both. Also, the image forming apparatus 100 may output images using a laser.

The input power may be alternating current (AC) signals of 110V or 220V that is supplied to the image forming apparatus 100. 110V and 220V indicate magnitudes of a voltage that is generally supplied to the image forming apparatus 100. However, input power having other voltage magnitudes may also be supplied to the image forming apparatus 100.

The phase detector 110 detects the phase of the input power. In detail, the phase detector 110 detects a zero cross point of the input power. The zero cross point refers to a point where a magnitude of the input power is zero. When the zero cross point is detected, the phase detector 110 generates a pulse signal and outputs the pulse signal to the phase controller 120.

The phase controller 120 detects the phase of the input power based on the pulse signal. Since a point when the pulse signal is detected is the zero cross point, the phase controller 120 may calculate the phase of the input power based on the zero cross point.

The phase controller 120 may control electric power supplied to the fuser heater 130 by performing a phase control operation, and thus, the fuser 140 may be heated. The phase controller 120 may perform the phase control operation based on the phase of the input power. That is, the phase controller 120 may determine electric power that is supplied to a lamp included in the fuser heater 130, and estimate a start phase and an end phase of the input power to supply the determined electric power. The phase controller 120 uses the input power to control an on/off timing of a switch included in the fuser heater 130, and thus, adjusts a temperature of the lamp.

The fuser heater 130 heats the fuser 140. The fuser heater 130 heats the fuser 140 by controlling electric current that is supplied to the fuser 140 based on a control signal received from the phase controller 120.

The fuser heater 130 includes a lamp and a switch. The lamp generates heat according to electric power supplied to the lamp. The fuser heater 130 may control the electric power supplied to the lamp by turning the switch on and off according to the control signal.

The fuser 140 fuses an image by heating a printing paper. The temperature of the fuser 140 is adjusted by the fuser heater 130.

Figure 2:
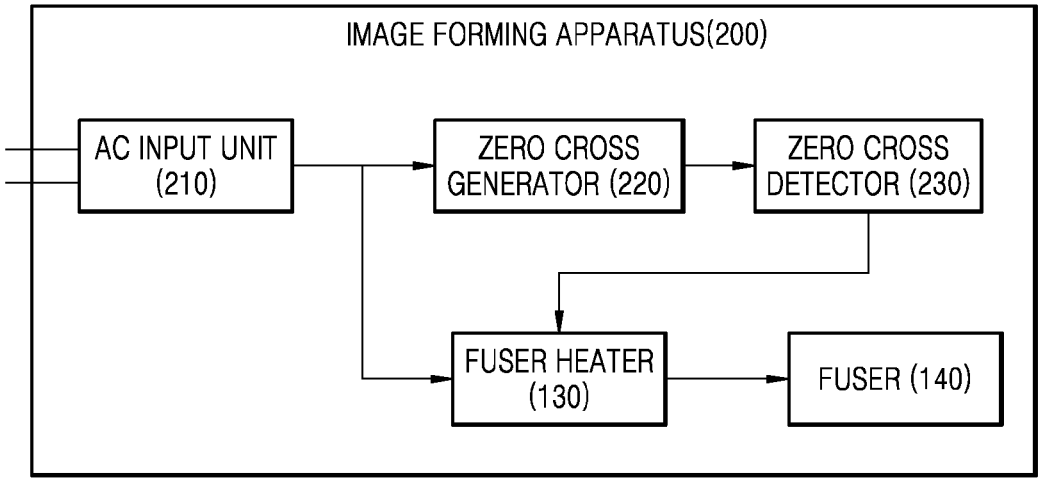
FIG. 2 is a block diagram of an image forming apparatus according to another exemplary embodiment.

FIG. 2 is a block diagram of an image forming apparatus 200 according to another exemplary embodiment. Referring to FIG. 2, the image forming apparatus 200 may include, for example, an AC input unit 210, a zero cross generator 220, a zero cross detector 230, the fuser heater 130, and the fuser 140. The image forming apparatus 200 may control the fuser heater 130 by using a phase control method.

The AC input unit 210 receives input power. For example, the input power may be an AC current.

The zero cross generator 220 outputs a zero cross signal at a zero cross point of the input power, for example, by using a photo coupler. The photo coupler may be divided into a first side and a second side. The first side includes a light-emitting device and the second side includes a light-receiving device that operates by absorbing light generated by the first side.

A compensation capacitor is connected in parallel at the first side of the photo coupler. In other words, the light-emitting device and the compensation capacitor are connected to each other in parallel. The compensation capacitor may reduce the distortion of the zero cross signal caused by noise in the input power. When the compensation capacitor is connected to the photo coupler, an increasing speed (or rise time) of the zero cross signal measured by the light-receiving device of the photo coupler is slower than when the compensation capacitor is not connected.

The zero cross generator 220 may include a first adaptive circuit that includes at least one capacitor at the first side of the photo coupler. The first adaptive circuit may be connected to the compensation capacitor in series or in parallel. Alternatively, the first adaptive circuit may be connected to the photo coupler instead of the compensation capacitor. The first adaptive circuit may include a switch that controls an operation of the at least one capacitor. The switch in the first adaptive circuit may be controlled by the zero cross detector 230. In other words, the zero cross detector 230 may control an on/off function of the switch, and the total capacitance of the first adaptive circuit may be determined according to whether the switch is on or off.

The zero cross detector 230 may convert the zero cross signal to the pulse signal, and detect a phase of the input power. When a pulse width of the pulse signal is less than a threshold value, the zero cross detector 230 may not detect the pulse signal and may not normally perform a phase control operation. When the zero cross signal is formed of triangular pulses, the zero cross detector 230 may clip the triangular pulses at a predetermined point and generate the pulse signal. If the zero cross detector 230 clips the zero cross signal at an excessively high point, a width of a pulse may be reduced, and if the zero cross signal is clipped at an excessively low point, the width of the pulse may be increased. Therefore, the zero cross detector 230 may adjust a point at which the zero cross signal is clipped by adjusting a ratio between resistors connected at the second side of the photo coupler.

The zero cross generator 220 may further include a second adaptive circuit for adjusting a ratio between resistors connected in series at the second side of the photo coupler. The zero cross detector 230 controls the second adaptive circuit according to a shape of the pulse signal. That is, the zero cross detector 230 monitors the pulse width of the pulse signal, and controls the second adaptive circuit to adjust the pulse width.

The zero cross detector 230 controls the first adaptive circuit according to the shape of the pulse signal and thus adjusts the total capacitance of the first adaptive circuit. For example, if the pulse width of the pulse signal is less than a threshold value, the zero cross detector 230 may control the first adaptive circuit such that the total capacitance of the first adaptive circuit is increased. Alternatively, if the pulse width of the pulse signal is greater than a threshold value, the zero cross detector 230 controls the first adaptive circuit such that the total capacitance of the first adaptive circuit is decreased.

At least two capacitors may be connected to the first adaptive circuit, and the first adaptive circuit may include switches that are respectively connected to the at least two capacitors. The zero cross detector 230 may control on/off of the switches so that a magnitude of the total capacitance of the first adaptive circuit is adjusted.

Figure 3:
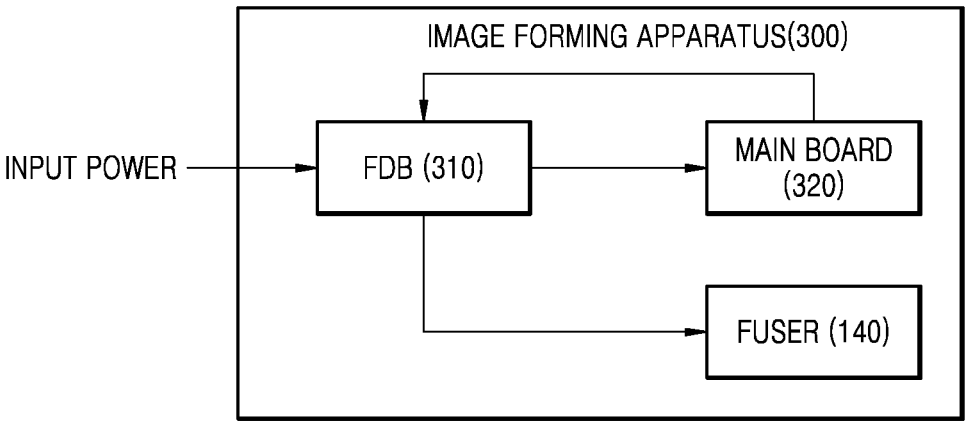
FIG. 3 is a block diagram of an image forming apparatus according to another exemplary embodiment.

FIG. 3 is a block diagram of an image forming apparatus 300 according to another exemplary embodiment. Referring to FIG. 3, the image forming apparatus 300 may include, for example, a fuser driver board (FDB) 310, a main board 320, and the fuser 140.

The FDB 310 uses a photo coupler to output a zero cross signal to the main board 320 at a zero cross point of input power. The zero cross signal may be formed of triangular pulses and be generated at a point where a magnitude of the input power is zero.

The FDB 310 includes the photo coupler and a compensation capacitor. The photo coupler includes a light-emitting device and a light-receiving device. In the photo coupler, a portion that is connected to the light-emitting device is referred to as a first side and a portion that is connected to the light-receiving device is referred to as a second side. The compensation capacitor may be connected to the light-emitting device in parallel. The compensation capacitor may reduce the distortion of the zero cross signal caused by noise in the input power.

The FDB 310 may further include an adaptive circuit. The adaptive circuit may be connected in parallel to the compensation capacitor. The adaptive circuit includes at least one capacitor. The adaptive circuit may include a switch that is connected to the at least one capacitor in series. Operations of the switch of the adaptive circuit are controlled by the main board 320.

The FDB 310 heats the fuser 140. The FDB 310 may include a switch and a lamp. The switch is controlled by the main board 320. The switch may supply electric power to the lamp or block the electric power. The main board 320 may calculate a phase of the input power and thus determine an on/off timing of the switch. An operation in which the main board 320 controls an on/off function of the switch is referred to as a phase control operation.

The main board 320 converts the zero cross signal to a pulse signal, and detects the phase of the input power based on the pulse signal. The main board 320 may determine a moment when the pulse signal is detected as a point when a magnitude of the input power is zero. Therefore, the main board 320 may determine the moment when the pulse signal is detected as the zero cross point, and may determine the phase of the input power based on the zero cross point.

The main board 320 may control the fuser heater 130 included in the FDB 310. The main board 320 includes a central processing unit (CPU) and the CPU may control supply of electric power to a lamp included in the fuser heater 130 or block electric power so as to increase or decrease a temperature of the fuser 140. The fuser heater 130 includes a switch that is connected to the lamp. The CPU may adjust a temperature of the lamp by adjusting an on/off timing or on/off periods of the switch.

Figure 4:
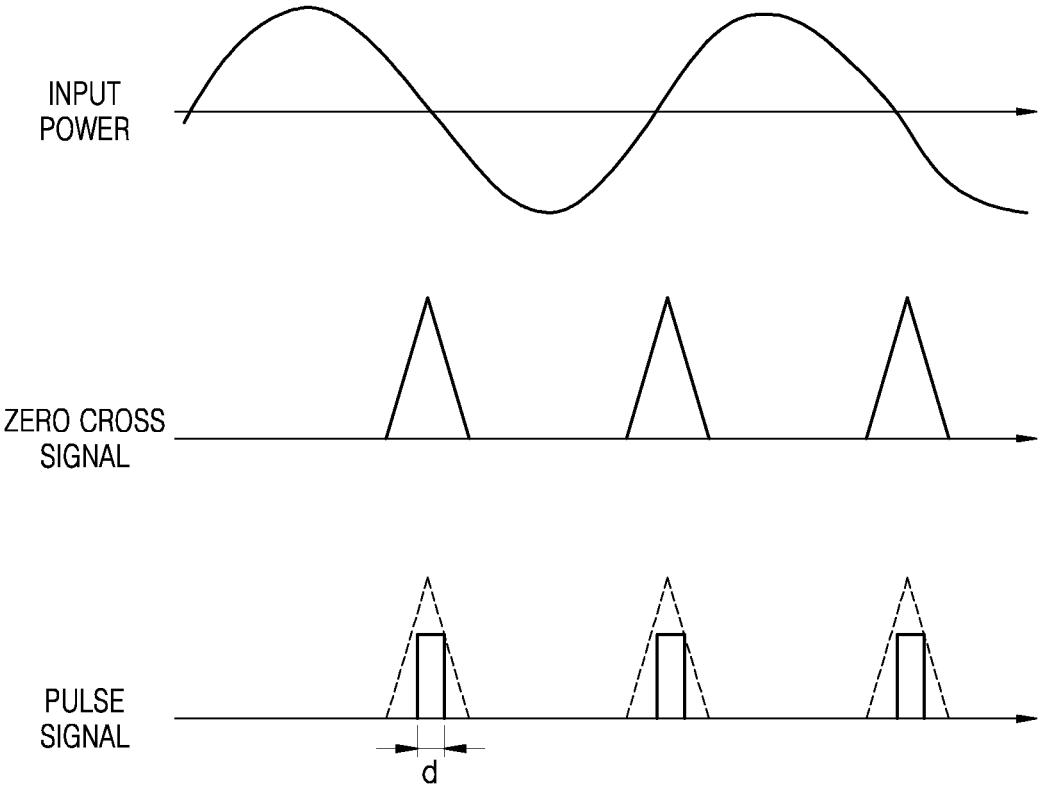
FIG. 4 is a diagram for describing a zero cross signal and a pulse signal.

FIG. 4 is a diagram for describing a zero cross signal and a pulse signal. Input power is a signal input to an image forming apparatus.

The zero cross signal is generated at a point where the input power meets a horizontal axis. For example, as shown in FIG. 4, the zero cross signal may be formed of triangular pulses.

The pulse signal is generated by clipping the zero cross signal. For example, the pulse signal may be formed of quadrilateral pulses. Therefore, the pulse signal may be detected as a digital signal by a CPU. That is, the CPU may determine a moment when the pulse signal is detected as a zero cross point.

A pulse width of the pulse signal is indicated by "d," as illustrated in FIG. 4. "d" may vary according to a height at which the zero cross signal will be clipped. The image forming apparatus may monitor a size and a pulse width of the pulse signal, and adjust a ratio between resistors included in the main board 320 based on a monitoring result. That is, when the pulse signal is not detected due to its small size or pulse width, the CPU adjusts the ratio between the resistors included in the main board 320.

Figure 5:
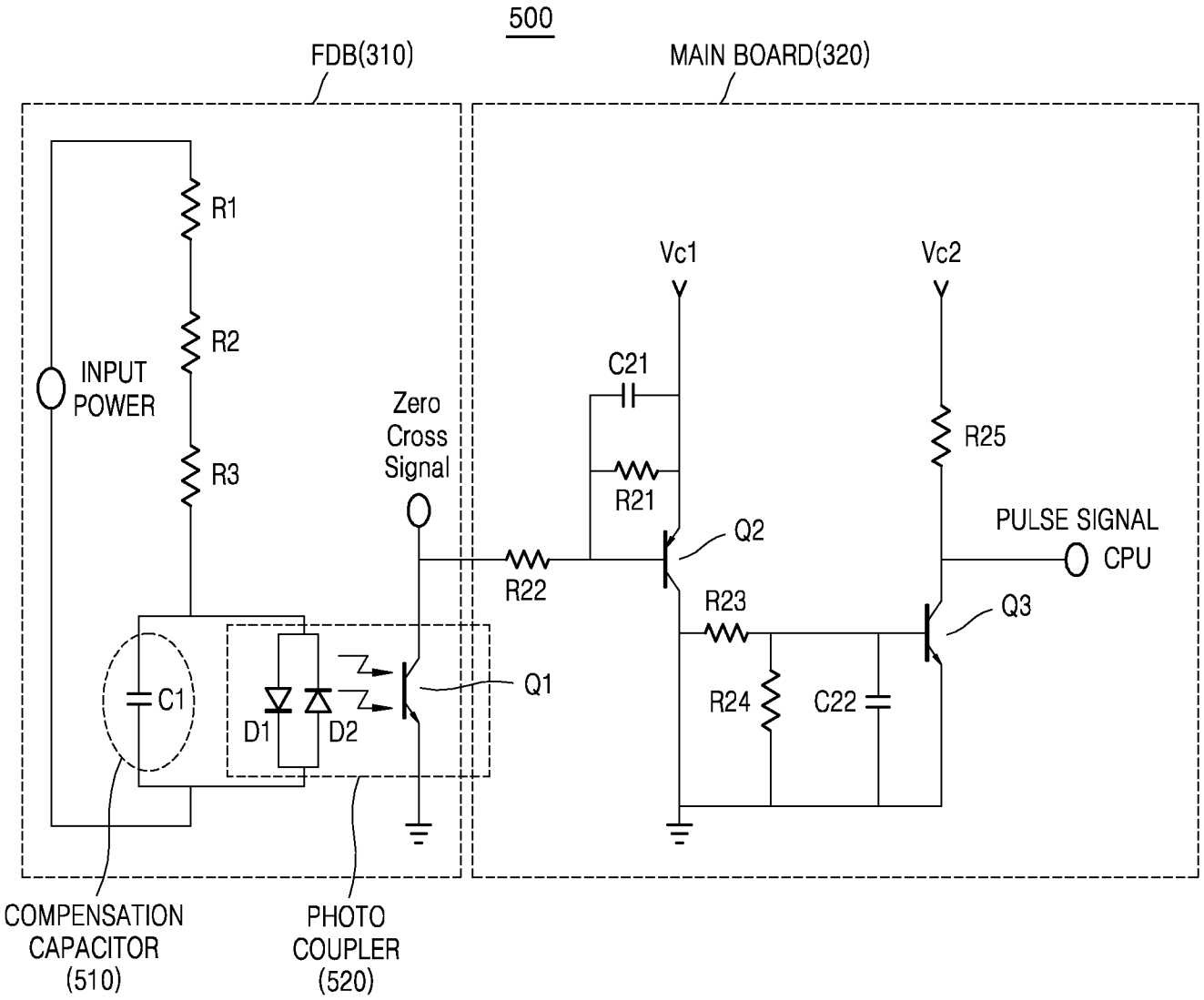
FIG. 5 is a circuit diagram of an image forming apparatus according to another exemplary embodiment.

FIG. 5 is a circuit diagram of an image forming apparatus 500 according to another exemplary embodiment. FIG. 5 only illustrates a circuit for detecting zero crossing in the image forming apparatus 500.

The FDB 310 includes a plurality of resistors R1 to R3, a photo coupler 520, and a compensation capacitor C1 510. The photo coupler 520 includes two diodes D1 and D2 and a transistor Q1. The two diodes D1 and D2 indicate light-emitting devices, and the transistor Q1 indicates a light-receiving device. The compensation capacitor C1 510 and the two diodes D1 and D2 are connected in parallel. The transistor Q1 operates by absorbing light that is generated by the diodes D1 and D2. The compensation capacitor C1 510 affects operations of the transistor Q1. A zero cross signal applied to the main board 320 is generated according to the operations of the transistor Q1.

The main board 320 includes a CPU, transistors Q2 and Q3, resistors R21 to R25, and capacitors C21 and C22. A collector of the transistor Q3 is connected to the CPU, and a pulse signal is output via the collector. A shape of the pulse signal may vary according to a ratio between the resistors R21 and R22. Therefore, the CPU may change the shape of the pulse signal by changing the ratio between the resistors R21 and R22 according to the shape of the pulse signal.

Figure 6:
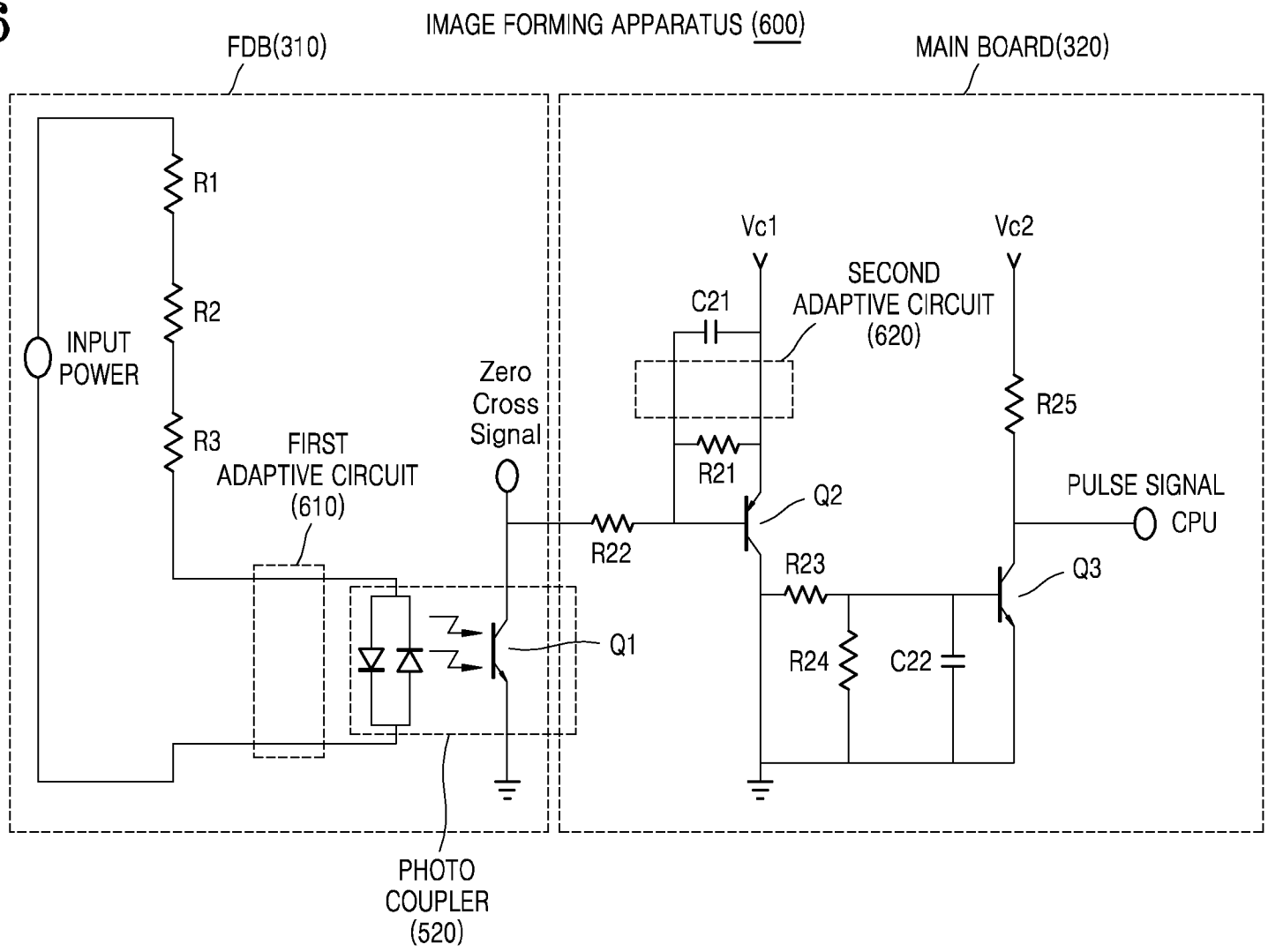
FIG. 6 is a circuit diagram of an image forming apparatus according to another exemplary embodiment.

FIG. 6 is a circuit diagram of an image forming apparatus 600 according to another exemplary embodiment. Referring to FIG. 6, the image forming apparatus 600 further includes a first adaptive circuit 610 and a second adaptive circuit 620.

The first adaptive circuit 610 may be connected to a first side of the photo coupler 520 in parallel and may include at least one capacitor and a switch. A CPU may control on/off of the switch included in the first adaptive circuit 610 so that a magnitude of a total capacitance of the first adaptive circuit 610 is changed. When a pulse width of a pulse signal decreases or the pulse signal is not detected for a predetermined amount of time, the CPU may increase the magnitude of the total capacitance of the first adaptive circuit 610.

The second adaptive circuit 620 may be connected to a second side of the photo coupler 520. The second adaptive circuit 620 may include at least one resistor and a switch. The CPU may control on/off of the switch included in the second adaptive circuit 620 so that a magnitude of a total resistance of the second adaptive circuit 620 is changed.

The CPU may compare the pulse width of the detected pulse signal and a reference value. When the pulse width of the pulse signal less than the reference value, the CPU may control the first adaptive circuit 610 or the second adaptive circuit 620 so that the pulse width of the pulse signal is increased.

Figure 7:
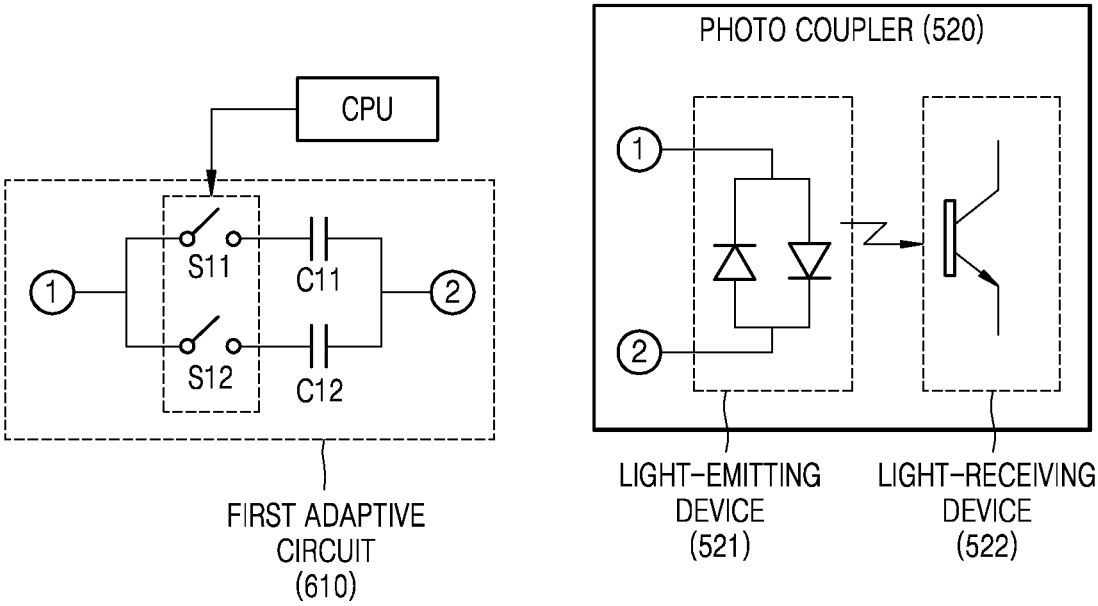
FIG. 7 is a diagram of a first adaptive circuit according to an exemplary embodiment.

FIG. 7 is a diagram of the first adaptive circuit 610 according to an exemplary embodiment. Referring to FIG. 7, the first adaptive circuit 610 includes two capacitors C11 and C12 and two switches S1 and S2. The two capacitors C11 and C12 are connected in parallel. The capacitor C11 is connected to the switch S1 in series and the capacitor C12 is connected to the switch S2 in series.

The switches S1 and S2 are controlled by the CPU. The CPU controls on/off of the switches S1 and S2 so that a total capacitance of the first adaptive circuit 610 is changed.

The first adaptive circuit 610 is connected to a light-emitting device 521 of the photo coupler 520. The photo coupler 520 includes the light-emitting device 521 and a light-receiving device 522. A first terminal of the first adaptive circuit 610 is connected to a first terminal of the photo coupler 520, and a second terminal of the first adaptive circuit is connected to a second terminal of the photo coupler 520.

Although FIG. 7 illustrates an example in which the first adaptive circuit 610 includes two capacitors, the first adaptive circuit 610 may include more than two capacitors. The capacitors may be connected in series, in parallel, or by using any other method. Each capacitor may be connected to a switch so that the capacitor is connected to or disconnected from another capacitor.

Figure 8:
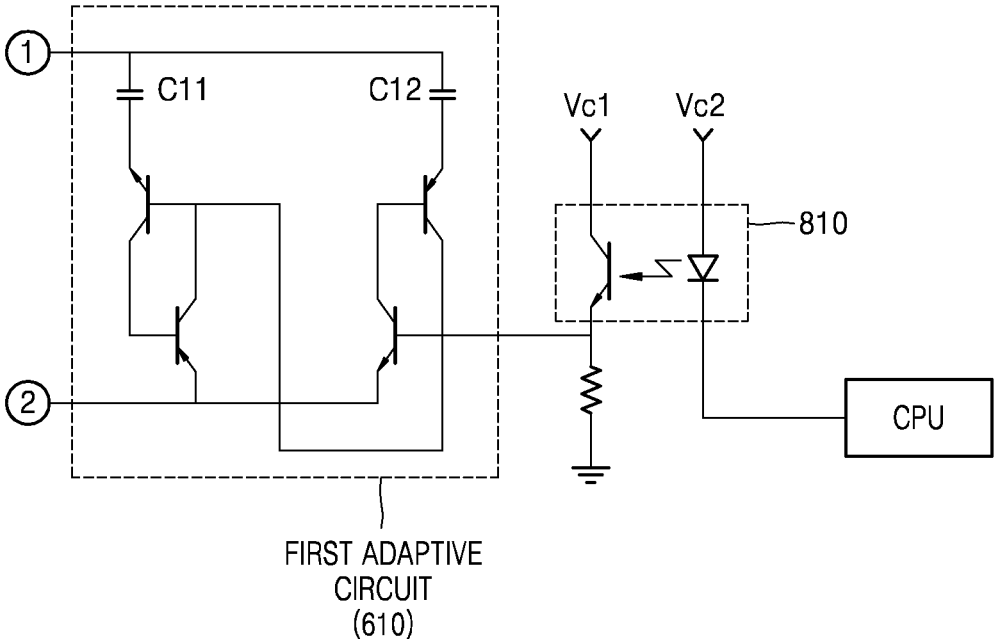
FIG. 8 is a circuit diagram of a first adaptive circuit according to an exemplary embodiment.

FIG. 8 is a circuit diagram of the first adaptive circuit 610 according to an exemplary embodiment. The circuit diagram of FIG. 8 is an embodiment of the first adaptive circuit 610 of FIG. 7. Therefore, details of the first adaptive circuit 610 described with reference to FIG. 7 may also applied to the first adaptive circuit 610 of FIG. 8.

Referring to FIG. 8, the first adaptive circuit 610 includes the two capacitors C11 and C12. A connection status of the capacitors C11 and C12 is determined by a CPU. The capacitors C11 and C12 are connected in parallel, and transistors connected to the capacitors C11 and C12 function as switches under the control of the CPU.

The CPU controls the first adaptive circuit 610 via a photo coupler 810. Since the first adaptive circuit 610 is electrically insulated from the CPU, the CPU outputs a control signal to the first adaptive circuit 610 via the photo coupler 810.

Figure 9A:
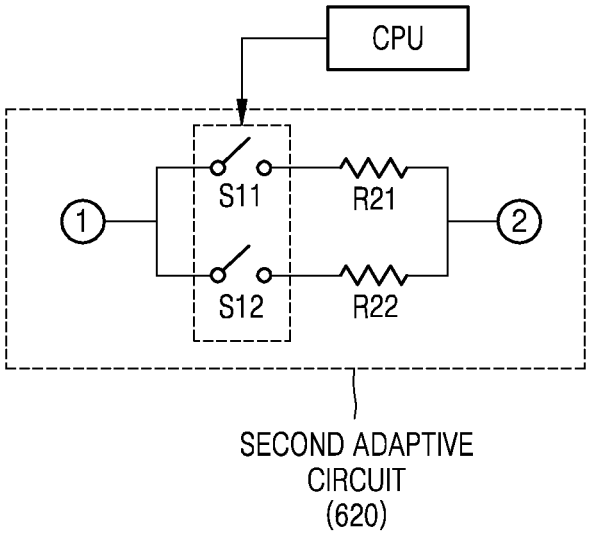
FIGS. 9A and 9B are diagrams of a second adaptive circuit according to an exemplary embodiment.
Figure 9B:
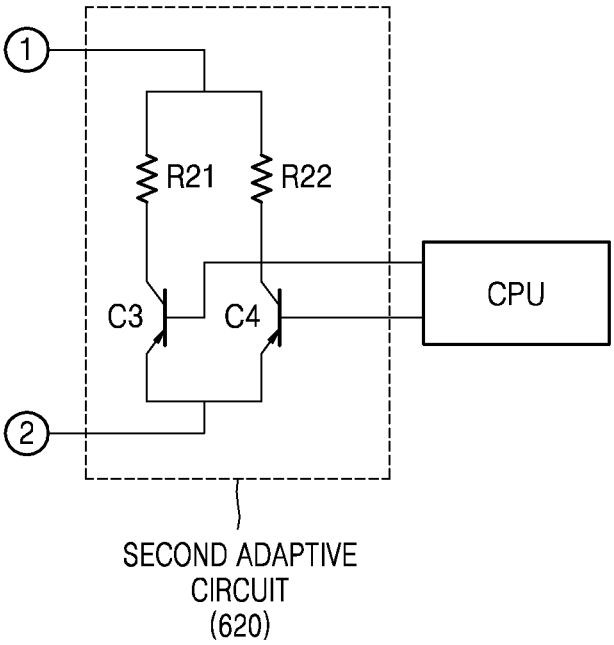

FIGS. 9A and 9B are diagrams of the second adaptive circuit 620 according to an exemplary embodiment. Referring to FIGS. 9A and 9B, FIG. 9A is a conceptual view of the second adaptive circuit 620 and FIG. 9B is a circuit diagram of the second adaptive circuit 620.

In FIG. 9A, the second adaptive circuit 620 includes two resistors R21 and R22 and two switches S11 and S12. The two resistors R21 and R22 are connected in parallel. The resistor R21 is connected to the switch S11 in series and the resistor R22 is connected to the switch S12 in series.

The switches S11 and S12 are controlled by a CPU. The CPU controls on/off of the switches S11 and S12 so that a magnitude of a total resistance of the second adaptive circuit 620 is changed.

Although FIG. 9A illustrates an example in which the second adaptive circuit 620 includes two resistors, the second adaptive circuit 620 may include more than two resistors. The resistors may be connected in series, in parallel, or by using any other method.

In FIG. 9B, the second adaptive circuit 620 includes the two resistors R21 and R22. A connection status of the resistors R21 and R22 is determined by the CPU. The resistors R21 and R22 are connected in parallel, and transistors connected to the resistors R21 and R22 function as switches under the control of the CPU.

First and second terminals of FIG. 9A and first and second terminals of FIG. 9B are respectively connected to both sides of the resistor R21 of FIG. 5.

Figure 10:
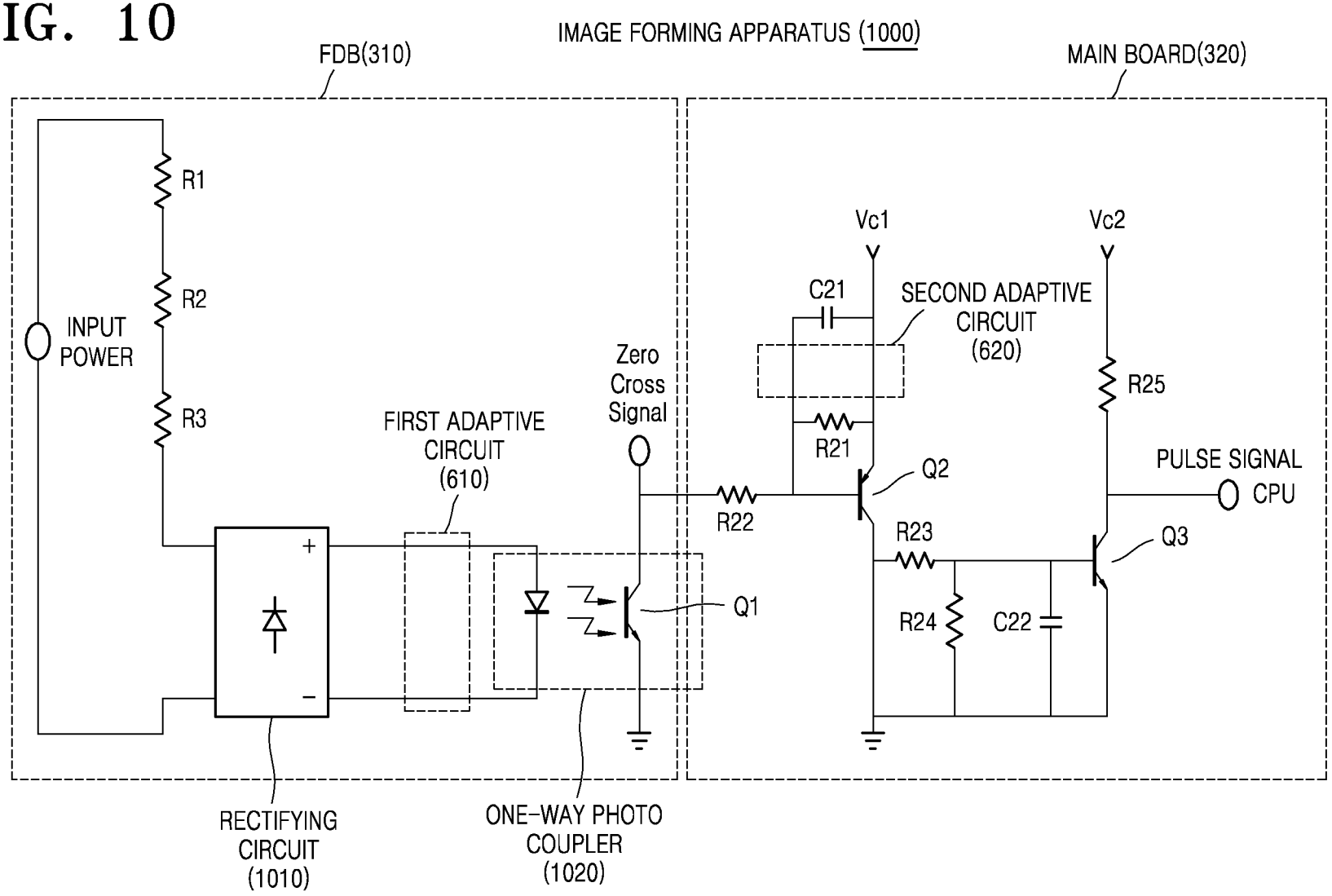
FIG. 10 is a circuit diagram of an image forming apparatus according to another exemplary embodiment.

FIG. 10 is a circuit diagram of an image forming apparatus 1000 according to another exemplary embodiment. Referring to FIG. 10, the image forming apparatus 1000 may include, for example, a rectifying circuit 1010 and a one-way photo coupler 1020.

The rectifying circuit 1010 converts AC to a direct current (DC) using a diode. The rectifying circuit 1010 includes at least one diode and may be a full-wave rectifying circuit that converts all waveforms of positive and negative poles of AC to DC. The rectifying circuit 1010 rectifies input power and outputs the rectified input power to the one-way photo coupler 1020.

The one-way photo coupler 1020 operates by receiving DC from the rectifying circuit 1010. The one-way photo coupler 1020 may include a diode and operate according to a magnitude of the received DC.

The image forming apparatus 1000 may further include the first adaptive circuit 610 or the second adaptive circuit 620. The first adaptive circuit 610 may be connected in parallel to a first side of the one-way photo coupler 1020 and may include at least one capacitor and a switch. A CPU may control on/off of the switch included in the first adaptive circuit 610 such that a magnitude of a total capacitance of the first adaptive circuit 610 is changed.

The second adaptive circuit 620 may be connected to a second side of the one-way photo coupler 1020. The second adaptive circuit 620 may include at least one resistor and a switch. The CPU may control on/off of the switch included in the second adaptive circuit 620 such that a magnitude of a total resistance of the second adaptive circuit 620 is changed.

Figure 11:
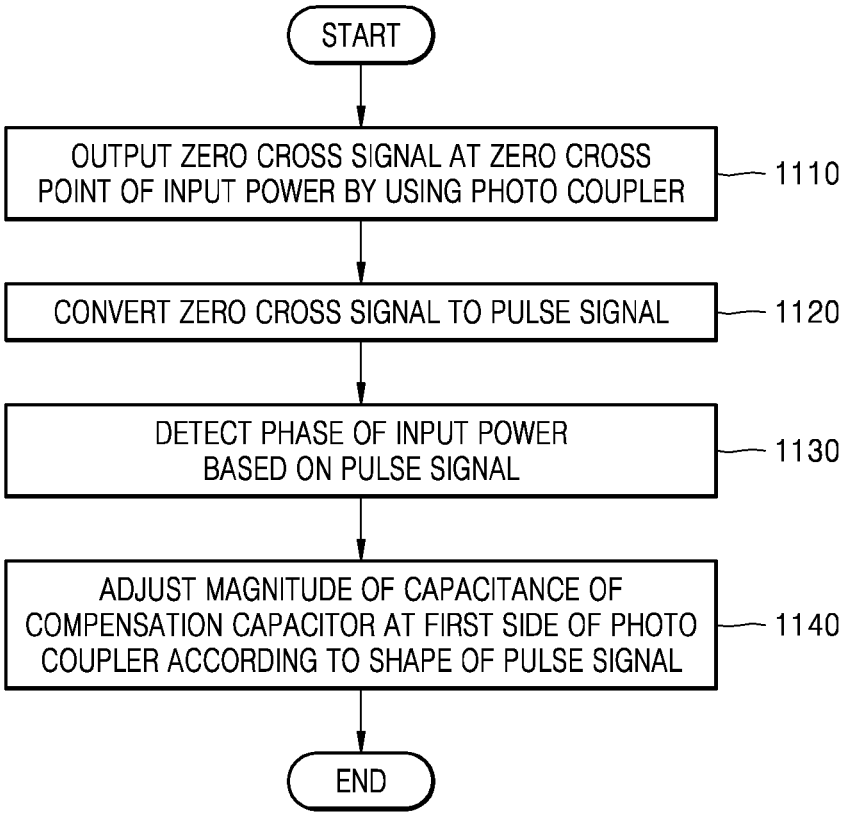
FIG. 11 is a flowchart of a phase detecting method according to an exemplary embodiment.

FIG. 11 is a flowchart of a phase detecting method according to an exemplary embodiment. The phase detecting method of FIG. 11 may be executed by any of the image forming apparatuses 100 to 300 of FIGS. 1 to 3 or by other apparatuses not described herein. Therefore, whether omitted or not, elements and features described with reference to the image forming apparatuses 100 to 300 are also applied to the phase detecting method of FIG. 11.

In operation 1110, an image forming apparatus outputs a zero cross signal at a zero cross point of input power using a photo coupler.

In operation 1120, the image forming apparatus converts the zero cross signal to a pulse signal. The image forming apparatus generates the pulse signal by clipping the zero cross signal.

In operation 1130, the image forming apparatus detects a phase of the input power based on the pulse signal. The image forming apparatus detects the pulse signal, and then determines the zero cross point of the input power.

In operation 1140, the image forming apparatus adjusts a magnitude of a capacitance of a compensation capacitor that is included at a first side of the photo coupler, according to a shape of the pulse signal. After adjusting the magnitude of the capacitance, the image forming apparatus may adjust the magnitude of the capacitance again based on the pulse signal. If a pulse width of the pulse signal is less or greater than a reference value, the image forming apparatus may not detect the pulse signal. If the image forming apparatus does not detect the pulse signal, the image forming apparatus does not detect the zero cross point of the input power, and thus, a phase control operation may not be performed. In other words, although the image forming apparatus needs to control a fuser at a certain phase based on the zero cross point, a phase to be controlled may be modified due to an error, and thus, the image forming apparatus may not be able to accurately control a temperature of the fuser.

The image forming apparatus may monitor a size, a pulse width, etc. of the pulse signal, and affect the size, the pulse width, etc. of the pulse signal by controlling a first adaptive circuit or a second adaptive circuit. Therefore, even when noise is included in the input power, the image forming apparatus may detect the zero cross point.

The device described herein may comprise a processor, a memory for storing program data and executing it, a permanent storage unit such as a disk drive, a communications port for handling communications with external devices, and user interface devices, including a touch panel, keys, buttons, etc. When software modules or algorithms are involved, these software modules may be stored as program instructions or computer-readable codes executable on a processor on a computer-readable medium. Examples of the computer-readable recording medium include magnetic storage media (e.g., ROM, floppy disks, hard disks, etc.), and optical recording media (e.g., CD-ROMs, or DVDs). The computer-readable recording medium can also be distributed over network coupled computer systems so that the computer-readable code is stored and executed in a distributive manner. This media can be read by the computer, stored in the memory, and executed by the processor.

The inventive concept may be described in terms of functional block components and various processing steps. Such functional blocks may be realized by any number of hardware and/or software components configured to perform the specified functions. For example, the inventive concept may employ various integrated circuit (IC) components, e.g., memory elements, processing elements, logic elements, look-up tables, and the like, which may carry out a variety of functions under the control of one or more microprocessors or other control devices. Similarly, where the elements are implemented using software programming or software elements, the inventive concept may be implemented with any programming or scripting language such as C, C++, Java, assembler language, or the like, with the various algorithms being implemented with any combination of data structures, objects, processes, routines or other programming elements. Functional aspects may be implemented in algorithms that are executed on one or more processors. Furthermore, the inventive concept could employ any number of conventional techniques for electronics configuration, signal processing and/or control, data processing and the like. The words "mechanism," "element," "means," and "configuration" are used broadly and are not limited to mechanical or physical embodiments, but can include software routines in conjunction with processors, etc.

The particular implementations shown and described herein are illustrative examples of the inventive concept and are not intended to otherwise limit the scope of the inventive concept in any way. For the sake of brevity, conventional electronics, control systems, software development and other functional aspects of the systems may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device.

The use of the terms "a" and "an" and "the" and similar referents in the context of describing the inventive concept (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the steps of all methods described herein can be performed in any suitable order unless otherwise indicated herein or otherwise clearly contradicted by context. The inventive concept is not limited to the described order of the steps. The use of any and all examples, or exemplary language (e.g., "such as") provided herein, is intended merely to better illuminate the inventive concept and does not pose a limitation on the scope of the inventive concept unless otherwise claimed. Numerous modifications and adaptations will be readily apparent to one of ordinary skill in the art without departing from the spirit and scope.

As described above, a phase detecting circuit according to the one or more of the above exemplary embodiments may accurately measure a phase of input power. The phase detecting circuit according to the one or more of the above exemplary embodiments may include a compensation capacitor connected in parallel at a first side of a photo coupler, and thus, distortion of a zero cross signal may be reduced. The phase detecting circuit according to the one or more of the above exemplary embodiments may adjust a capacitance of the first side of the photo coupler according to a shape of a pulse signal. The phase detecting circuit according to the one or more of the above exemplary embodiments may adjust the capacitance of the first side of the photo coupler such that a pulse width of the pulse signal is adjusted. The phase detecting circuit according to the one or more of the above exemplary embodiments may adjust a ratio between resistors connected at a second side of the photo coupler according to a shape of the pulse signal. The phase detecting circuit according to the one or more of the above exemplary embodiments may adjust the pulse width of the pulse signal by adjusting the ratio between the resistors connected at the second side of the photo coupler.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A phase detector for detecting a phase of input power for driving a fuser of an image forming apparatus, the phase detector comprising:

a zero cross generator that outputs a zero cross signal at a zero cross point of the input power by using a photo coupler, wherein a compensation capacitor is connected in parallel at a first side of the photo coupler; and a zero cross detector that converts the zero cross signal to a pulse signal and detects the phase of the input power based on the pulse signal, wherein the zero cross generator further comprises an adaptive circuit comprising a capacitor at the first side of the photo coupler, and the zero cross detector adjusts a total capacitance of the adaptive circuit by controlling the adaptive circuit according to a shape of the pulse signal.

2. The phase detector of claim 1, wherein the photo coupler comprises a light-emitting device at the first side and a light-receiving device at a second side, and the compensation capacitor is connected in parallel to both sides of the light-emitting device.

3. The phase detector of claim 1, wherein if a pulse width of the pulse signal is less than a threshold value, the zero cross detector controls the adaptive circuit such that a magnitude of a total capacitance of the adaptive circuit is increased.

4. The phase detector of claim 1, wherein if a pulse width of the pulse signal is greater than a threshold value, the zero cross detector controls the adaptive circuit such that a magnitude of a total capacitance of the adaptive circuit is reduced.

5. The phase detector of claim 1, wherein the adaptive circuit comprises a plurality of capacitors that are connected in parallel and a plurality of switches that are respectively connected to the capacitors in series, and the zero cross detector controls an on/off function of the switches.

6. The phase detector of claim 1, wherein the adaptive circuit is connected to either the photo coupler or the compensation capacitor.

7. The phase detector of claim 1, wherein the photo coupler comprises a light-emitting device at the first side and a light-receiving device at a second side, the phase detector further comprises an adaptive circuit for adjusting a ratio between resistors connected in series at the second side of the photo coupler, and the zero cross detector controls the adaptive circuit according to a shape of the pulse signal.

8. The phase detector of claim 1, further comprising an alternating current (AC) input unit to which the input power is applied.

9. An image forming apparatus for driving a fuser by controlling a phase, the image forming apparatus comprising:

a fuser driver board that outputs a zero cross signal at a zero cross point of input power by using a photo coupler, wherein a compensation capacitor is connected in parallel to a first side of the photo coupler; and a main board that converts the zero cross signal to a pulse signal and detects a phase of the input power based on the pulse signal, wherein the fuser driver board further comprises an adaptive circuit having a capacitor and connected in parallel to the compensation capacitor.

10. The image forming apparatus of claim 9, wherein the main board further comprises:

a fuser heater having a switch and a lamp; and a CPU to adjust an on/off timing or on/off periods of the switch to control a temperature of the lamp.

11. A method of detecting a phase of input power for driving a fuser of an image forming apparatus, the method comprising:

outputting a zero cross signal at a zero cross point of the input power by using a photo coupler;

converting the zero cross signal to a pulse signal;

detecting the phase of the input power based on the pulse signal; and adjusting a magnitude of a capacitance of a compensation capacitor at a first side of the photo coupler according to a shape of the pulse signal.

12. The method of claim 11, wherein the adjusting comprises increasing the magnitude of the capacitance if a pulse width of the pulse signal is less than a threshold value.

13. The method of claim 11, wherein the adjusting comprises reducing the magnitude of the capacitance if a pulse width of the pulse signal is greater than a threshold value.

14. The method of claim 11, wherein the adjusting comprises adjusting a ratio between resistors connected in series at a second side of the photo coupler.

15. A non-transitory computer-readable recording medium having recorded thereon a program, which, when executed by a computer, performs the method of claim 11.

16. A method of controlling a temperature of a fuser via a fuser heater in an image forming apparatus, the method comprising:

detecting a phase of AC power input to the image forming apparatus; and controlling an electric power supplied to the fuser heater by adjusting a compensation capacitor in a photo coupler according to the detected phase of the AC power input to the image forming apparatus.

* * * * *